United States Patent [19]

Schwartz

[11] 4,027,998

[45] June 7, 1977

[54] FIXING ARRANGEMENT FOR A GUIDE PART OF A FIXED CASING ON A ROTATING MACHINE

[75] Inventor: René Schwartz, Belfort, France

[73] Assignee: Groupe Europeen pour la Technique des Turbines a Vapeur G.E.T.T. S.A., Paris, France

[22] Filed: Jan. 14, 1976

[21] Appl. No.: 649,002

[30] Foreign Application Priority Data

Jan. 16, 1975 France ..... 75.01301

[52] U.S. Cl. ..... 415/219 R; 415/101; 248/19

[51] Int. Cl.[2] ..... F01D 25/24

[58] Field of Search ..... 415/219 R, 219 C, 200, 415/101, 100; 248/19

[56] References Cited

UNITED STATES PATENTS

| | | | |
|---|---|---|---|
| 1,373,896 | 4/1921 | Loewenstein | 415/200 |
| 1,840,741 | 1/1932 | Reid | 248/19 |
| 2,802,632 | 8/1957 | Byers | 248/19 |
| 2,842,955 | 7/1958 | Pedersen | 248/19 |
| 2,998,216 | 8/1961 | Hurd | 248/19 |

FOREIGN PATENTS OR APPLICATIONS

| | | | |
|---|---|---|---|
| 2,010,805 | 9/1971 | Germany | 415/219 R |

*Primary Examiner*—Henry F. Raduazo
*Attorney, Agent, or Firm*—Sughrue, Rothwell, Mion, Zinn & Macpeak

[57] ABSTRACT

A fixing arrangement for a guide part of a fixed casing on a rotating machine whose rotor is supported by a concrete beam, is characterized in that the guide part is fixed to a plate applied against a lateral wall of the beam and is integral with trusses sunk in the mass of the beam. The invention applies, more particularly, to steam turbine exhaust chambers.

2 Claims, 2 Drawing Figures

FIXING ARRANGEMENT FOR A GUIDE PART OF A FIXED CASING ON A ROTATING MACHINE

BACKGROUND OF THE INVENTION

1. Field of the Invention

The invention concerns the fixing of a longitudinal guide part used for securing a fixed casing on a rotating machine and it applies, more particularly, to the securing of steam turbine exhaust chambers and of alternator bodies.

2. Description of the Prior Art

Up till now, those guide parts have been fixed on the journals of the machines, but the result of this is difficulty in assembling, in centering the journals and casings and in accessibility for adjustments. Moreover, when the concrete stand on which the journals rest is in the form of a beam in an overhanging position, the load borne by that beam becomes excessive and the latter must be reinforced.

It has been found, according to the present invention, that it was possible, simultaneously, to separate the fixing device of the guide parts from the journals, to obviate the above-mentioned disadvantages and to reinforce the concrete stand.

For that purpose, the invention provides a fixing device for a longitudinal guide part for a casing on a rotating machine whose rotating part is supported by at least one journal resting on a concrete beam, characterized in that this guide part is installed on a plate applied against a lateral wall of the beam and integral with trusses sunk in the mass of concrete of the beam.

These trusses are, to great advantage, constituted by ribs fixed on the said plate and tie-rods fixed at one end to these ribs and fixed, at their other ends, to ribs of a second plate applied against another lateral wall of the beam opposite to the aforementioned lateral wall.

That second plate can, more particularly, accomodate a longitudinal guide part for the fixed casing of another rotating machine.

With reference to the accompanying diagrammatic figures, a description is given of an example having no limiting character of the implementing of the invention.

DESCRIPTION OF THE PREFERRED EMBODIMENT

Figure 1:
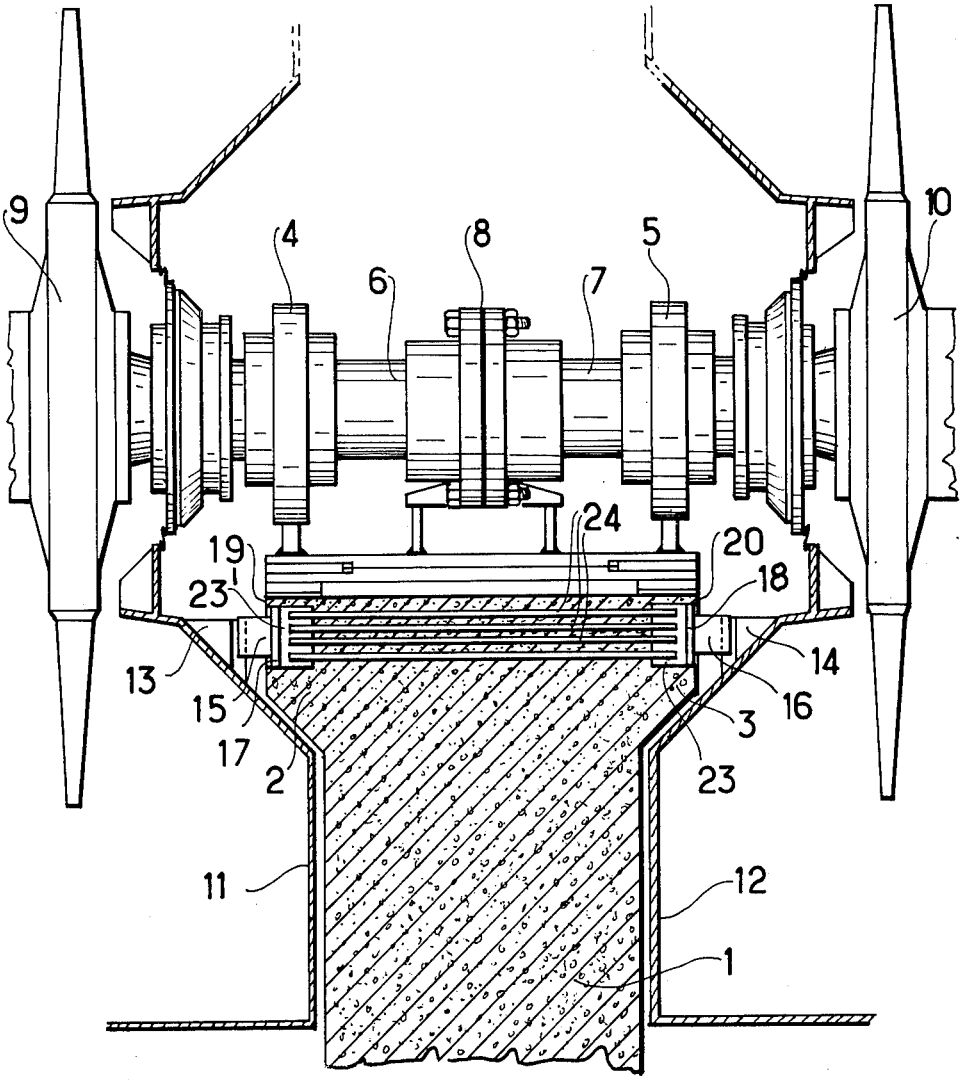
FIG. 1 is a longitudinal sectional view of the ends of two neighbouring axial steam turbines and of the concrete beam for supporting the shaft of those turbines, situated between the ends.

In FIG. 1, a beam 1, constituted by a concrete mass forming two overhanging portions 2 and 3 at its top part, bears journals 4 and 5 of a pair of shafts 6, 7 connected together by a coupling sleeve 8. The shafts 6 and 7 bear, respectively, the rotors 9 and 10 of two steam turbines of which only a small portion is shown. The exhaust chambers 11 and 12 of those turbines, which must be able to: move axially under the effect of variations in temperature, have bracket supports 13, 14, which can slide longitudinally on guide parts 15 and 16 mounted on the beam 1. These guide parts are installed on plates 17, 18, fixed on opposite lateral walls 19 and 20 of the beam 1, at respective portions 2 and 3.

Figure 2:
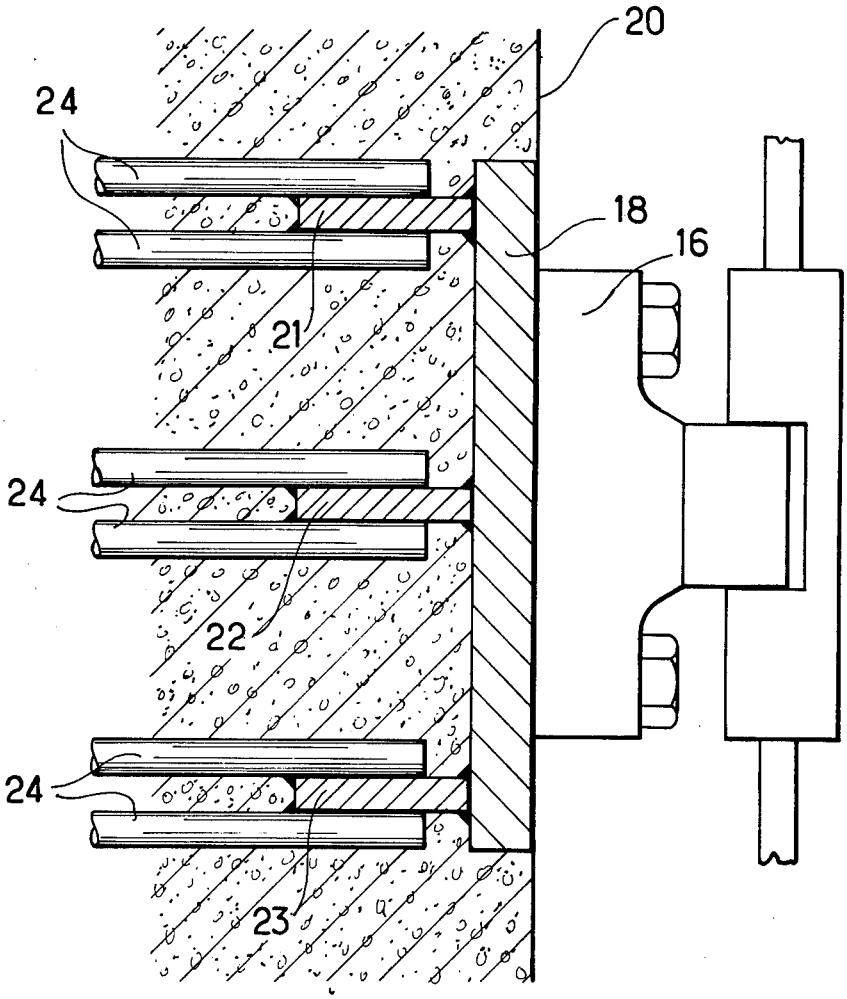
FIG. 2 is, on a larger scale, a horizontal cross-section view of the fixing device for the guide parts of the exhaust chambers of those turbines.

The plates 17 and 18 carry ribs such as the ribs 21, 22, 23, which can be seen in FIG. 2 and are constituted by vertical plates extending over the whole height of the plate 17 ar 18 and spaced out in the horizontal direction along the width of that latter plate to which they are welded. Tie-rods 24 consisting of round iron fittings which extend from the ribs of one of the plates 17 to the ribs of the plate 18, crossing the whole upper part of the beam 1, are welded onto these ribs 21, 22, 23. Those tie-rods 24 are spaced out in the vertical direction on the ribs of the plates, as will be seen in FIG. 1, where it is sectioned such that the concrete in the front of the plates has been removed to enable the first rib 23, 23′ of the plate 17, 18 and the tie-rods linking those ribs 23, 23′, to be seen.

At the time of the assembling, the round iron fittings constituting the tie-rods 24 are cut to the required length and welded onto the ribs of the plates, then the concrete is run. Those tie-rods 24 are used for keeping the plates 17, 18 rigid and also constitute the truss of the concrete of the beam 1 in the top zone of the latter, where lies the two overhanging parts 2 and 3.

Access to the guide parts 15 and 16 and the adjusting thereof in order to centre the exhaust chambers 11 and 12 properly easy, that adjusting being independent from that necessitated by the centring of the journals 4 and 5. The devices used for the adjusting of the guide parts have not been shown, for they are of a conventional type.

I claim:

1. In a machine assembly comprising:

at least one machine having at least one rotating machine part, a concrete support beam, a first journal bearing mounted to the top of said concrete beam and rotatably supporting said rotating machine part for rotation about the part axis, and a casing for said at least one machine, the improvement comprising:

a first casing guide part fixed to said casing and extending longitudinally relative to said rotating machine part, a second guide part, and means for fixing the second guide part to said beam in juxtaposition to said first part, with said second part extending longitudinally adjacent said first guide part to guide said casing in its movement relative to said beam, and wherein said means for fixing said second guide part to said beam comprise first and second plates positioned against opposed lateral walls of said concrete beam, said plates including vertical ribs sunk in the mass of concrete forming said beam, and horizontal tie rods extending laterally and being fixed respectively to the ribs of said first and second plates, and wherein said second guide part is fixed to one of said plates on the side opposite that of said concrete embedded ribs.

2. The machine assembly as claimed in claim 1, wherein said at least one machine comprises two in number, each machine includes at least one rotating machine part, a second journal bearing is mounted to the top of said concrete beam and rotatably supports the rotating machine part of the second machine for rotation about that part axis, a second casing is provided for the second machine, and includes a casing guide part which extends longitudinally relative to the second machine rotating machine part, and the other of said first and second plates carries a guide part which is in juxtaposition to the guide part of said second machine casing and which extends longitudinally, adjacent thereto for guiding movement of said second machine casing relative to said concrete beam.

* * * * *